United States Patent [19]

Labbe

[11] Patent Number: 4,643,203

[45] Date of Patent: Feb. 17, 1987

[54] CONVEYING AND UNITING ROD-LIKE ARTICLES OF THE TOBACCO INDUSTRY

[75] Inventor: Francis A. M. Labbe, Neuilly-sur-Seine, France

[73] Assignee: Molins PLC, London, England

[21] Appl. No.: 508,399

[22] Filed: Jun. 27, 1983

[30] Foreign Application Priority Data

Jul. 1, 1982 [GB] United Kingdom ..... 8219096

[51] Int. Cl.[4] ..... A24C 5/47

[52] U.S. Cl. ..... 131/94; 131/95

[58] Field of Search ..... 131/282, 39, 283, 94, 131/95

[56] References Cited

U.S. PATENT DOCUMENTS

| | | | |
|---|---|---|---|
| 2,162,424 | 6/1939 | Edwards | 131/94 |
| 2,188,998 | 2/1940 | Edwards | 131/94 |
| 2,205,943 | 6/1940 | Davidson . | |
| 3,506,017 | 4/1970 | Schubert | 131/94 |

FOREIGN PATENT DOCUMENTS

| | | | |
|---|---|---|---|
| 0081021 | 6/1983 | European Pat. Off. . | |
| 1246495 | 8/1967 | Fed. Rep. of Germany | 131/94 |
| 0731861 | 6/1955 | United Kingdom | 131/94 |
| 0767906 | 2/1957 | United Kingdom | 131/94 |
| 0773017 | 4/1957 | United Kingdom | 131/94 |
| 0814383 | 6/1959 | United Kingdom | 131/94 |
| 0872047 | 7/1961 | United Kingdom | 131/94 |
| 0941832 | 11/1963 | United Kingdom | 131/94 |
| 1604347 | 12/1981 | United Kingdom . | |

*Primary Examiner*—V. Millin

*Attorney, Agent, or Firm*—John C. Smith, Jr.

[57] ABSTRACT

In the production of filter cigarettes by a process in which the tobacco sections and filter portions are united while moving in an axial direction, the wrapper sections are resiliently pressed onto the abutting tobacco sections and filter portions, preferably by resilient pads. The pads are carried by a suction conveyor and their spacing may be adjusted by means for changing their timing or path length, to suit different lengths of tobacco sections and filter portions. The tobacco sections and filter portions may be assembled on a suction conveyor adapted to allow axial adjustment of the position of a conveyed article following slight lateral displacement of the article to reduce the suction grip of the conveyor.

22 Claims, 7 Drawing Figures

CONVEYING AND UNITING ROD-LIKE ARTICLES OF THE TOBACCO INDUSTRY

Figure 1:
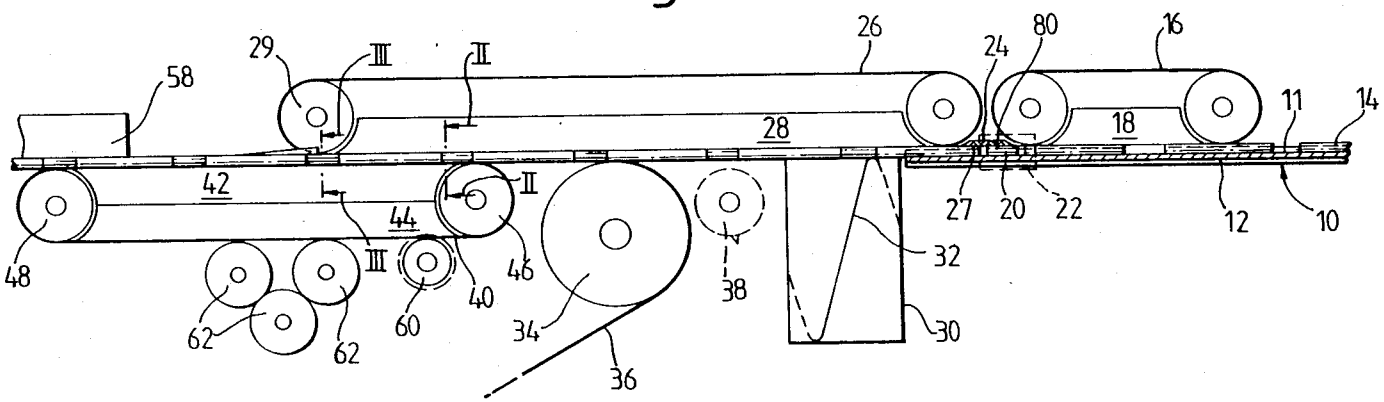

This invention relates to conveying and uniting axially-aligned rod-like articles of the tobacco industry.

In the assembly of filter cigarettes, axially-aligned filter portions and tobacco sections are united by means of a wrapper section which surrounds at least the adjacent end portions of the filter portions and tobacco sections. It is clearly desirable that the filter portions and tobacco sections are securely united, and to achieve this a tight or close wrap is beneficial. This is particularly so in the case of ventilated cigarettes (in which the wrapper section has small holes which allow restricted flow of air into the filter portion to dilute the tobacco smoke) where a good seal between the wrapper and the filter portion is important.

According to one aspect the invention provides a method of uniting axially-aligned rod-like articles of the tobacco industry, in which a wrapper is applied at least over the adjacent end portions of the articles, wherein the wrapper is pressed onto and around the articles while being conveyed along with them, the pressure applied to the wrapper to wrap it around said end portions being greater than that applied (if any) to other parts of the articles. The wrapper may be resiliently pressed onto and around the articles while being conveyed along with the articles, preferably in an axial direction.

The method may be used to unite a continuous rod comprising alternating rod-like articles of different characters, e.g. tobacco sections and filter portions or different types of filter portions, in which case the wrapper may be continuous or may be cut into spaced wrapper sections each of which spans one or more junctions between adjacent articles. Alternatively, the method may be used for uniting discrete spaced groups of rod-like articles, in which case spaced wrapper sections are applied. The wrapper (or wrapper section) may be partially adhesively secured to the rod-like articles (e.g. by centre line gumming) before being resiliently pressed onto the articles.

The means for applying pressure need not be resilient. For example, the wrapper could be pressed onto the articles by a substantially rigid member which compresses the articles (in the region of the wrapper), the articles recovering afterwards by their natural resilience. The articles could be conveyed in an axial direction, or in a direction transverse to their lengths. Regions for applying increased pressure to press the wrapper onto the articles could be included in a rolling plate similar to that disclosed in British Patent Specification No. 1487422, so that after initial rolling has started pressure is reduced on those parts not covered by the wrapper; the alleviation of pressure on the tobacco sections when the articles to be united comprise tobacco sections and filter portions can reduce breakage of tobacco fibres.

According to another aspect the invention provides apparatus for uniting axially-aligned rod-like articles, comprising means for conveying the articles in an axial direction, means for feeding a wrapper, and means for wrapping the wrapper around at least the adjacent end portions of the articles to unite them, the wrapping means being arranged to resiliently press the wrapper onto and around the articles. The wrapping means may include a conveyor, e.g. an endless band conveyor consisting of substantially continuous flexible resilient material and backed by suitable guide means (which may be supplied with air under pressure to act as an air bearing to reduce frictional contact between the conveyor and guide means). The guide means may press the conveyor onto and around the articles to correspondingly wrap the wrapper around at least the adjacent end portions of the articles. Such an arrangement is particularly suitable for uniting a continuous rod including alternating component rod-like articles to be enclosed in a continuous wrapper. In a preferred arrangement, however, spaced wrapper sections are applied over predetermined junctions between adjacent rod-like articles at a location upstream of the wrapping means. In that case the wrapping means preferably comprises conveyor means having spaced sections adapted to resiliently press the wrapper onto and around the articles. The spaced sections may comprise raised portions. In a preferred arrangement the conveyor means includes an endless band conveyor carrying spaced pads of flexible resilient material. A suction band conveyor may be used, the pads being retained on the conveyor by suction. As with a continuous resilient conveyor, guide means (possibly in combination with an air bearing) may be provided to wrap the conveyor (and conveyed pads) around the articles to press the wrapper onto the articles. The pads may be of composite structure and/or may include one or more cavities.

The spacing of pads (or other spaced sections, e.g. raised portions) carried by a conveyor of the wrapping means is preferably adjustable. In order to accommodate significant changes in required spacing between pads, to adjust lengths between wrapper sections being applied to the rod-like articles, the total path length for the pads may be adjusted by means of further conveyors, e.g. drums, onto which the pads may be diverted and around which they may be passed on a path of variable length before being returned to the wrapping conveyer. Such adjustment of path length may be rendered largely unnecessary if discrete groups of component rod-like articles are assembled upstream of the wrapping conveyor and the spacing between the centres of said groups maintained substantially unchanged for various lengths of the components of the groups. Small adjustments of the position of each pad relative to the conveyor may be made by means of pad timing means such as a timing wheel having a projecting cam to hold up or advance a pad as appropriate and driven synchronously with the wrapper feeding means.

The conveying means for the articles preferably cooperates with timing means by which groups of abutted rod-like articles are assembled and fed forward at a predetermined rate. Spaced wrapper sections are subsequently fed in suitably timed sequence so that they are picked up by the groups (by means of previously-applied adhesive) and conveyed in substantially flat condition over the conveyor of the wrapping means (which, for this purpose, overlaps the article conveying means). The timing of the resilient pads corresponds to that of the groups and wrapping means, and the articles and wrapper (together with the pads) are subsequently conveyed through a garniture including the previously-mentioned guide means and folders to seal the wrapper around the groups and unite the assemblies.

By providing a resilient means between the wrapper and guide means it is possible to press the wrapper onto the rod-like articles to ensure a tight wrap and a good seal. This is particularly important in the assembly of filter cigarettes having controlled ventilation.

According to a further aspect of the invention apparatus for conveying rod-like articles of the tobacco industry comprises a suction conveyor for conveying the articles on a path, means for transversely displacing slightly an article on said path, to allow leakage of suction past the article thereby reducing the grip of the conveyor on the article, and means for causing axial movement of the article relative to the conveyor while said article is transversely displaced. Preferably the displacing means causes lateral displacement of the article but in certain cases, e.g. with flat oval filter portions, it may be easier to displace the article in a transverse direction which is substantially at right angles to the conveying surface of the suction conveyor. The movement causing means could be a friction surface (which may itself include suction ports) against which the article is pressed by the displacing means so that it is slowed relative to the conveyor. Alternatively, the displacing means may be arranged such that the suction of the conveyor is reduced sufficient to allow a preceding or following article, itself being conveyed by a further conveyor at a velocity somewhat different from that of the conveyor, to move said article. Another possibility is that the article may be accelerated or decelerated directly by an adjacent conveyor moving at a speed different from that of said conveyor while the displacing means causes the grip of said conveyor to be reduced. Said adjacent conveyor may itself be a suction conveyor.

The apparatus is particularly usefully employed in the assembly of abutting groups of rod-like articles for subsequent uniting into assemblies. In a particular application a leading article is slowed so that the following article, being conveyed by the same conveyor, is moved into abutment with it and subsequently the whole group is moved forward by the conveyor for transfer onto another conveyor on which the group is united by application of a wrapper section.

The displacing means may comprise a timing member arranged to displace only selected articles which pass it. For example, it may be required that only the article which eventually will form the leading article of a group of articles conveyed by the conveyor should be displaced so that it may be slowed relative to the conveyor to assemble the group. The displacing means may then comprise cam means. Two or more such means may operate on each article to ensure that it is displaced evenly and in a direction transverse to the conveyor direction (i.e. so that the article remains parallel to the conveyor direction). Downstream of the displacing means guide means may be provided for returning the displaced article onto its original path and under the full influence of the suction conveyor.

In order that a small displacement of an article from a suction conveyor should cause a significant reduction in the effective suction applied to maintain the article on the conveyor, the suction ports acting through the conveyor and on the article in the vicinity of the displacing means are preferably provided with restrictors which restrict the flow of air and therefore reduce the effective suction available when leakage occurs. Similar restrictors could be provided in suction ports arranged in a friction surface towards which the displacing means moves the article, so that in normal circumstances the effect of the suction acting through those ports is insufficient by itself to slow an article. If, however, the article is displaced so that it substantially covers said ports then suction acting on the article through the ports will draw the article against the surface and slow it.

Figure 3:
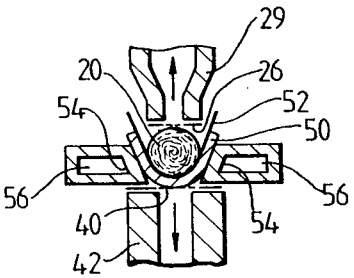
Figure 2:
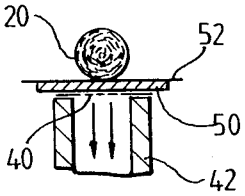
Figure 4:
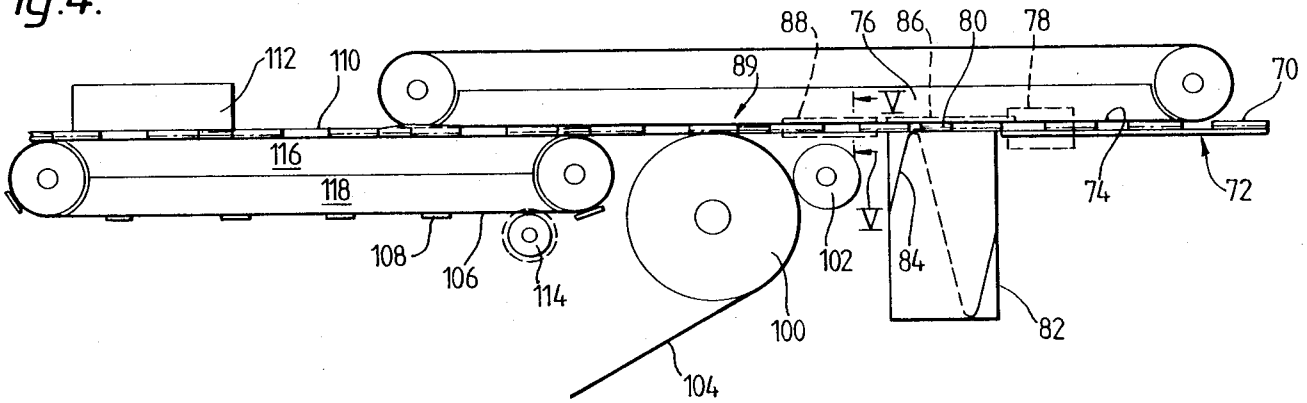
Figure 5:
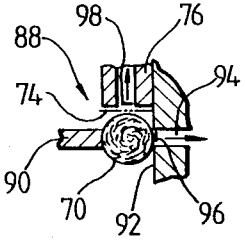
Figure 6:
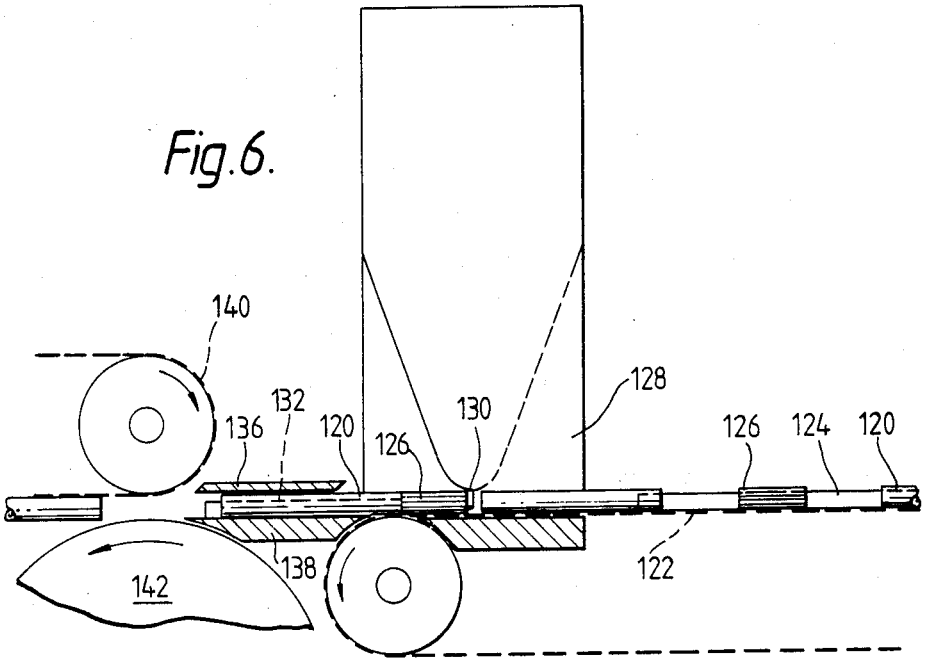
Figure 7:
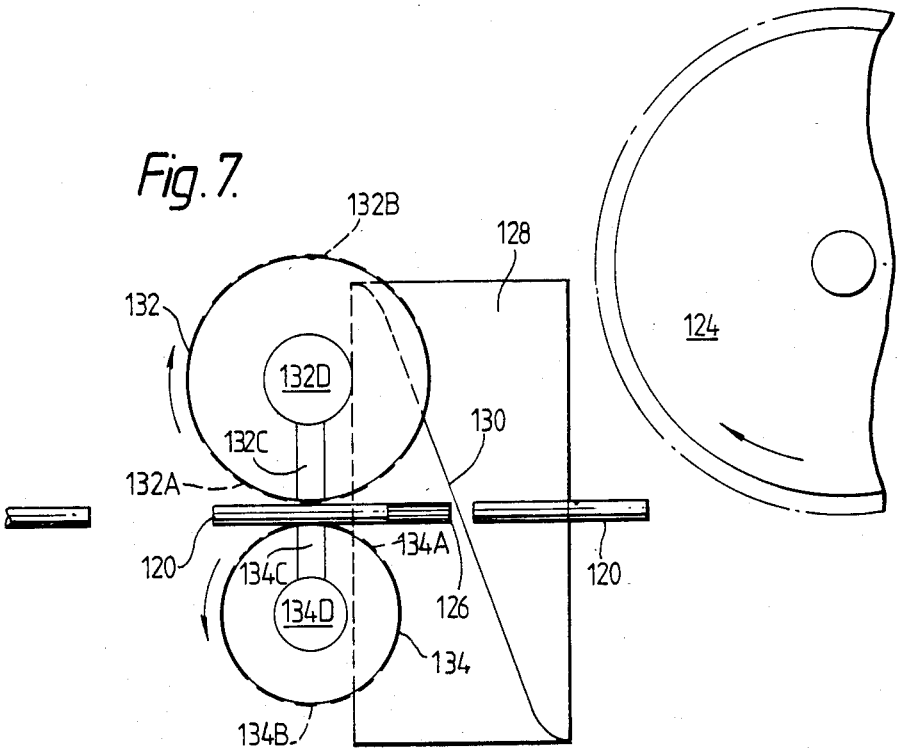

The invention will be further described, by way of example only, with reference to the accompanying diagrammatic drawings, in which:

FIG. 1 is a side view of apparatus for assembling and uniting a continuous line of rod-like articles, FIG. 2 is a transverse sectional view on the line II—II of FIG. 1, FIG. 3 is a transverse sectional view on the line III—III of FIG. 1, FIG. 4 is a side view of apparatus for assembling and uniting groups of rod-like articles, FIG. 5 is a transverse sectional view on the line V—V of FIG. 4, FIG. 6 is a side view of further apparatus for assembling groups of rod-like articles, and FIG. 7 is a plan view of the apparatus of FIG. 6.

The apparatus shown in FIGS. 1–3 comprises a guide plate 10 having a U-shaped channel 11 communicating with a pressure air manifold 12 to provide an air bearing for tobacco lengths 14 received directly from the cut-off of a continuous rod cigarette making machine. A permeable endless conveyor 16 is arranged above the channel 11 and cooperates with a suction chamber 18 to convey and separate successive tobacco lengths 14. Immediately downstream of the conveyor 16 a filter portion 20 is inserted into each space between successive tobacco lengths 14 by an insertion device 22 which may be substantially identical to any of the devices for this purpose disclosed in British patent specification No. 971491. The filter portions are delivered into the channel 11 under a bridging plate 24 located between the conveyor 16 and a suction assembly conveyor 26. In order to impart additional axial velocity to the filter portions 20 the plate 24 may be provided with air jets 27 angled in the direction of conveyance of the portions and tobacco lengths 14. The plate 24 may be modified for this purpose in a manner similar to the member 216 disclosed in British patent specification No. 1578737. Instead of separating the conveyors 16 and 26 as shown in FIG. 1 the conveyor 16 could be arranged below the line of conveyance of the tobacco lengths 14, so that an overlap could be provided between the conveyors and no bridge plate 24 would be required.

The conveyor 26 cooperates with a suction manifold 28 and has a velocity somewhat lower than that of the conveyor 16 so that the gaps between the alternating tobacco lengths 14 and filter portions 20 are closed up. Near the upstream end of the conveyor 26 is a rotatable timing worm 30 provided with at least one projecting thread 32. The peripheral speed of the worm 30 and the angle of the thread 32 are such that a portion of the thread engages the rear face of each filter portion 20 and advances it into abutment with the preceding tobacco length 14. In addition, at each occasion that the thread 32 disengages a filter portion 20 the position of the line of tobacco lengths 14 and filter portions stretching downstream is accurately determined. Thus, suction applied by conveyor 26 should be such that small movements of the tobacco lengths 14 and filter portions 20 are possible. For more details of the construction and operation of a timing device similar to the worm 30 reference is directed to said British patent specification No. 971491.

The abutting line of tobacco lengths 14 and filter portions 20 conveyed by the conveyor 26 downstream of the worm 30 passes over a cork applicator drum 34 on which a web of simulated cork wrapper material 36 travelling at a controlled speed is cut by a rotary knife 38 and delivered as spaced cork patches spanning each filter portion 20 and overlapping the ends of adjacent tobacco lengths 14. The wrapper 36 carries adhesive for sticking it to the filter portions 20 and tobacco lengths 14 and also for subsequently forming a lap seal. The peripheral speed of the cork applicator drum 34 is close to that of the suction conveyor 26.

The conveyor 26 conveys the tobacco lengths 14 and filter portions 20 and attached cork patches over a suction tape 40 which passes over upper and lower suction manifolds 42, 44 and around suction pulleys 46, 48. The tape 40 carries flexible compressible pads 50 (FIGS. 2, 3) at spaced intervals corresponding to the positions of the cork patches 52 applied over the filter portions 20. As indicated in FIG. 2 the pads 50 are retained on the conveyor 40 by suction and are flat when they initially contact the flat cork patch 52 carried by the filter portion 20. Subsequently, as shown in FIG. 3, the sides of the pads 50 are engaged by side guides 54 which progressively bend the pads, and hence the cork patches 52, around the adjacent filter portions 20. The guides 54 form sides of pressure air manifolds 56 so that running friction of the pads 50, which are still engaged by the tape 40 to which suction is applied from the manifold 42, is kept low. Downstream of the end pulley 29 of the conveyor 26 the pads 50 and cork patches 52 are further wrapped around the filter portions 20 and a conventional lap seal produced by means of a heater 58 (or heater and cooler 58). The continuous rod thus produced is passed into a continuous rod cut-off for severing into separate rod lengths.

The pads 50 ensure a tight wrap of the cork patches around the filter portions and the ends of the tobacco lengths, the resilience of the pads pressing on the cork patches.

The pads 50 remain on the conveyor 40 and are conveyed along its lower run by means of suction manifold 44. The timing of the pads 50 on the conveyor 40, i.e. the control of the position of each pad 50 so that it arrives on the upper run of the conveyor 40 in a position exactly corresponding to that of a cork patch 52, is maintained by a timing wheel 60 carrying an abutment which may advance (or retard) each pad slightly relative to the conveyor 40.

It is necessary to vary the spacing between pads 50 on the conveyor 40 in accordance with the particular lengths of tobacco lengths 14 and filter portions 20. Adjustment may be made by varying the effective path length of the conveyor 40 by causing pads 50 to travel around suction rollers 62 instead of directly along the lower run of conveyor 40. Adjustment of the positions of the centres of the rollers 62 provides a significant alteration of path length. If, however, this is insufficient pads 50 can be added or removed.

It is contemplated that the same pads 50 would be useful for a wide variety of tobacco length and filter portion diameters and for a variety of filter portion lengths. Typically the pad width might be about 80% of the filter portion circumference, and have a length not less than that of the cork patch 52. The thickness of a pad may typically be of the order of 1.5 mm.

The pads 50 may have a composite structure comprising longitudinal (i.e. parallel to the filter portion axis) threads embedded in a moulded flexible carrier material. The threads may be of nylon, polyamide or a similar substance and the carrier may be of silicon rubber. A woven structure having a majority of longitudinal threads could be used. The pads should be flexible for wrapping around the cork patches and enclosed filter portion but have some rigidity in the longitudinal direction for conveyance and timing. Particularly for use with non-circular (e.g. oval) filter portions the pads may have V-shaped or other grooves in their surface to aid folding around small diameter parts of the portions.

FIGS. 4 and 5 show further apparatus for assembling filter cigarettes. The apparatus is somewhat similar to that of FIGS. 1–3 but is arranged so that separate double filter cigarette assemblies are produced, so that no cut-off is required.

Cigarette portions 70 delivered from a plain cigarette maker are received on a plate 72 which is similar to the plate 10. An upper suction conveyor 74 cooperating with a suction manifold 76 accelerates the portions 70 to space them apart. A filter portion insertion device 78, similar to the device 22, introduces a filter portion 80 into alternative spaces between cigarette portions 70, so that each filter portion is arranged between leading and trailing cigarette portions.

A timing worm 82 carrying at least one thread 84 which projects into the path of the portions 70, 80 is arranged downstream of the device 78. The peripheral axial speed of the thread 84 along said path is less than that of the conveyor 74 and the timing is such that the thread engages the leading face of each filter portion 80. The result is that each filter portion 80 is retarded so that the trailing cigarette portion 70 moves into abutment with it. Suction applied in a region 86 of the manifold 76 may be reduced to allow these portions 80, 70 to be retarded by the thread 84.

Downstream of the worm 82 a braking device 88, shown more clearly in FIG. 5, causes each leading cigarette portion 70 to be retarded so that each filter portion 80 and trailing cigarette portion 70 which has been timed by the thread 84 move together into abutment with said leading cigarette portion to create a group 89 comprising leading and trailing cigarette portions and an interposed filter portion. The device 88 comprises two spaced cams 90 each rotatable about a substantially vertical axis and acting together to displace each leading cigarette portion 70 by a small amount in a lateral direction. Two spaced cams 90 are used so that the portion 70 remains parallel to itself while it is displaced. The lateral displacement is sufficient to reduce the suction attraction of the manifold 76 through the conveyor 74 and, further, the side of the leading cigarette portion remote from the cams 90 comes into contact with a stationary guide surface 92 which includes a suction manifold 94. The effect of this is that the leading portion 70 is retarded relative to the conveyor 76 by frictional engagement with the guide surface 92 and manifold 94. The suction manifold 94 includes a restrictor 96; similarly, the manifold 76 includes a restrictor 98, at least in the region of the device 88. These restrictors 96, 98 restrict the flow of air into the respective manifolds 94, 76 when leakage occurs so that the suction effect on a filter or cigarette portion is greatly reduced if it does not seal the respective manifold. The cams 90 may be belt driven from the drive to the filter portion insertion device 78, and are arranged so that only leading cigarette portions 70 are displaced.

Each leading cigarette portion 70 is retarded by the guide surface 92 and the manifold 94 until the filter portion 80 and trailing cigarette portion 70 contact it.

The suction force retaining these on the conveyor 74 is higher than the braking force on the leading filter portion, so that the abutted assembly is subsequently conveyed as a group 89 by the suction conveyor 74. The surface 92 is shaped to guide the leading cigarette portion 70 back to the centre line of the conveyor 76 and into alignment with the other members of the group 89. The timing of each group 89 is set by the release point of the thread 84 on the leading end of the filter portion 80 and is not lost by contact with the leading cigarette portion 70, the action of the braking device 88 on the leading cigarette portion 70 being insufficient to cause any longitudinal displacement of the filter portion 80 and trailing cigarette portion 70.

Downstream of the braking device 88 the spaced groups 89 pass to a cork patch applicator drum 100, having a cork cutting drum 102, at which a cork patch cut from a cork web 104, is applied over the filter portion 80 and the adjacent ends of the cigarette portions 70. Subsequently the group 89, still carried by the suction conveyor 74, moves over a suction tape 106 which carries pads 108 which are similar to the pads 50. The group 89 is transferred onto the suction conveyor 106 and is conveyed into and through a garniture comprising folders 110 and a heater 112. The wrapping of the cork patch around group 89 by means of the folders 110 and with the aid of pads 108, is similar to that described with reference to the apparatus of FIGS. 1–3. The timing of the pads 108 on the conveyor 106 is adjusted, so that their positions correspond to the positions of the filter portions 70 on the conveyor 74, by means of a timing wheel 114.

Since individual groups 89 are united in the garniture no continuous rod cut-off is required and the assembled groups 89 pass directly to a catcher drum or the like. The spacing of the pads 108 on the conveyor 106 is determined by the spacing of the filter portions 80. As this can remain unchanged for a wide range of lengths of filter portion and cigarette portion change of path length of the conveyor 106 to adjust the spacing of the pads (other than for small timing changes made by the wheel 114) is not required. Further, the speeds of the conveyors 74 and 106 can remain the same, whereas in the apparatus of FIG. 1 the speeds of the conveyors 26 and 40 are increased with increasing assembly lengths. A further advantage of the FIG. 4 arrangement is that where a timing worm is used to retard filter portions it is possible to arrange that the reaction on the filter portion can be along its length with no sideways force tending to laterally displace it.

The suction conveyor 106 carrying the pads 108 cooperates with suction manifolds 116, 118; each of these manifolds may be provided with restrictors (similar to the restrictors 96, 98) to reduce the air flow, and hence the loss of suction in the manifolds, where the pads 18 are not present. The manifolds 18 and 44 in the apparatus of FIG. 1 could similarly be provided with restrictors.

Another arrangement for assembling an abutted group of cigarette portions and filter portions is shown in FIGS. 6 and 7. Cigarette portions 120, received directly from a plain cigarette maker, are spaced apart by a lower suction conveyor 122 travelling at a speed V1 which is sufficiently in excess of the speed of delivery of the cigarette portions to create a required gap between the portions. A plug insertion device (which may be similar to the devices 22 and 78) including a rotatable disc 124 having a peripheral speed $V_1$ introduces a filter portion 126 into this gap. A rotatable timing worm 128 having a projecting thread 130 is arranged so that the thread enters the gap behind each of the filter portions 126. The linear axial velocity of the thread 130 need not be constant (since the angle of the thread may change) but its timing velocity, i.e. the velocity at which the filter portion is conveyed when that portion is in abutment with the preceding cigarette portion and that cigarette portion is engaged between downstream conveyors as explained below, is $V_2$, where $V_2$ is predetermined and constant.

Each filter portion 126 is retarded, so that its rear face is engaged by the thread 130, by contact with the preceding cigarette portion 120 which is itself retarded by the action of cooperating discs 132, 134, rotating about substantially vertical axes and arranged to engage the sides of the cigarette portions 120 just downstream of the timing worm 28 and in the region of upper and lower guide plates 136, 138.

The first suction disc 132 comprises first and second porous regions 132A and 132B which, on rotation of the disc, pass in turn over a stationary air port 132C leading to a central manifold 132D. Similarly, the disc 134, which is of smaller diameter than the disc 132, includes porous regions 134A and 134B and surrounds a stationary air port 134C and central manifold 134D. The disc 132 is rotated at a peripheral speed $V_3$ and the disc 134 is rotated at a peripheral speed $V_4$, where $V_3 > V_1 > V_2 > V_4$.

The timing of the discs 132 and 134 is such that the regions 132A and 134A contact the leading cigarette portion of each group to be assembled (as shown in FIG. 7) and the regions 132B and 134B contact the trailing cigarette portion. During the period when the regions 132A and 134A are passing the respective ports 132C and 134C the manifold 132D is supplied with air under pressure and the manifold 134D is supplied with suction. The effect of this is that the leading cigarette portion 120 is pressed onto the disc 134 and is slowed to its peripheral speed $V_4$ which, being less than the linear speed $V_2$ of the thread 130, causes that cigarette portion and the following filter portion 126 to be pushed into abutment by the thread and subsequently conveyed at velocity $V_2$.

The abutting leading cigarette portion 120 and filter portion 126 continue to be conveyed at velocity $V_2$ by the thread 130, slipping if necessary past the discs 132, 134, and the leading cigarette portion is engaged between an upper suction conveyor 140 and a cork patch applicator drum 142, both of which have a peripheral linear speed at $V_2$. Subsequently, when the portion of the thread 130 engaging the rear face of the filter portion 126 reaches its most forward position, so that conveyance of the filter portion stops, the timing is not lost since the leading cigarette portion 120 is still conveyed at velocity $V_2$ by the conveyor 140 and drum 142. Any gap which is then created between the leading cigarette portion 120 and the filter portion 126 is eventually closed up by the filter portion being accelerated and pushed forward by engagement of the trailing cigarette portion as explained below.

The trailing cigarette portion 120 is conveyed at speed $V_1$ by the conveyor 122. As $V_1 > V_2$ the gap between it and the preceding filter portion 126 is constantly closing. When the trailing filter portion reaches the discs 132, 134 it is further accelerated to close the gap completely. This occurs because when the trailing cigarette portion arrives at the discs 132, 134 these have rotated so that the porous regions 132B and 134B contact it and the air supply lines leading to the manifolds 132D, 134D are switched so that the manifold 134D is supplied with pressure air and the manifold 132D is supplied with suction. This results in the trailing cigarette portion being pressed against the disc 132 and conveyed at its peripheral speed $V_3$ which, being higher than both $V_2$ and $V_1$, results in the trailing cigarette portion being accelerated into contact with the filter portion 126 and subsequently pushing it back into abutment with the leading cigarette portion being conveyed on the suction tape 140. The conveying force applied by the disc 132, being applied over only a small proportion of the length of the trailing cigarette portion, is insufficient to overcome the force applied by the conveyor 140 along the length of the leading cigarette portion, so that no movement of the leading cigarette portion relative to its conveyor occurs and the timing now inherent in the position of the leading cigarette portion is not lost.

Downstream of the cork patch applicator drum 142 the apparatus may be substantially identical to the corresponding part of the apparatus of FIGS. 4 and 5.

Instead of using pressure air to urge the cigarette portions against the opposing discs 132 or 134 to aid suction conveyance, mechanical means, such as shallow cams, could be used.

I claim:

1. Apparatus for uniting adjacent axially-aligned rod-like articles of the tobacco industry, comprising means for transporting said articles successively in an axial direction, means for feeding a wrapper towards said articles, and means for wrapping said wrapper around at least the adjacent end portions of said adjacent articles to unite them while they are being transported by said transport means in said axial direction, said wrapping means comprising resilient means to resiliently press said wrapper onto and around said articles.

2. Apparatus according to claim 1, wherein the wrapping means includes conveyor means for the wrapper.

3. Apparatus for uniting axially-aligned rod-like articles of the toabcco industry, comprising means for feeding a wrapper, means for wrapping said wrapper received from said feeding means around adjacent end portions of articles delivered to said wrapping means, a suction conveyor for conveying said articles successively in an axial direction along a path towards said wrapping means, means for transversely displacing slightly an article on said path to allow leakage of suction past said article thereby reducing the grip of said conveyor on said article, and means for causing axial movement of said article relative to said conveyor while said article is tranversely displaced to bring an end of said article adjacent an end of another article on said conveyor.

4. Apparatus according to claim 3, wherein said means for causing transverse displacement is arranged to cause lateral displacement relative to said conveyor.

5. Apparatus according to claim 4, wherein said means for causing axial movement comprises a friction surface.

6. Apparatus according to claim 4, wherein said means for causing axial movement comprises a further conveyor which directly or indirectly moves said article.

7. Apparatus according to claim 3, including guide means downstream of the displacing means for returning said article to said path.

8. Apparatus according to claim 3, further comprising means defining at least one suction port adapted to cooperate with said suction conveyor and through which suction is applied to articles on said path, said port including a restriction for restricting the flow of air and thereby rapidly reducing the suction effect on an article when leadkage occurs due to displacement of said displacing means.

9. A method of uniting axially-aligned articles of the tobacco industry, in which a wrapper is applied about at least the adjacent end portions of said articles, wherein the wrapper and resilient means in contact with the outer surface of said wrapper are pressed onto and progressively wrapped around said articles while said resilient means and wrapper are conveyed with said articles, the pressure applied to said wrapper to wrap it around said end portions being maintained by continuous contact of said resilient means on the outer surface of said wrapper during substantially the entire uniting operation and being greater than any pressure applied to other portions of said articles.

10. A method of uniting axially-aligned articles of the tobacco industry, in which a wrapper is applied over at least the adjacent end portions of said articles, wherein said articles are conveyed in an axial direction and said wrapper is pressed onto and around said articles while being conveyed along with them, the pressure, applied to said wrapper, by means conveyed with said wrapper and said articles, to wrap said wrapper around said end portions, being substantially greater than any pressure applied to other portions of said articles.

11. A method according to claim 10, wherein a stream of articles and a stream of wrappers are fed in synchronism along converging paths to a position at which the wrappers are pressed onto and around at least some of said articles.

12. A method according to claim 11, wherein selected adjacent ends of the articles are not united by a wrapper, so that separate composite rods each comprising a plurality of articles united by at least one wrapper is produced.

13. A method of uniting a plurality of successive axially-aligned articles of the tobacco industry, in which wrappers are applied over at least the adjacent end portions of at least some of said articles such that the applied wrappers are spaced from each other, wherein each of said wrappers and an individual resilient means in contact with the outer surface of said wrapper are pressed onto and progressively wrapped around said articles while said individual resilient means and wrapper are conveyed with said articles, a plurality of said individual resilient means being spaced from each other in correspondence with the spacing of said wrappers from each other on said articles, the pressure applied to each of said wrappers to wrap it around said adjacent end portions being maintained by continous contact of one of said individual resilient means on the outer surface of each of said wrappers during substantially the entirety of each uniting operation and being greater than any pressure applied to other portions of said articles.

14. Apparatus for uniting axially-aligned rod-like articles of the tobacco industry, comprising means for transporting said articles in an axial direction, means for feeding a wrapper towards said articles, and means for wrapping said wrapper around at least the adjacent end portions of said articles to unit them, said wrapping means comprising a laterally flexible band, guide means for causing said band to wrap said wrapper around said articles and resilient means on said band to resiliently press said wrapper onto and around said articles.

15. Apparatus for uniting axially-aligned rod-like articles of the tobacco industry, comprising means for transporting said articles successively in an axial direction, means for feeding a succession of wrappers towards said articles, and means for wrapping said wrappers around at least the adjacent end portions of as least some of said articles to unit them, said wrapping means comprising conveyor means including spaced sections adapted to resiliently press said successive wrappers onto and around said articles.

16. Apparatus according to claim 15, wherein said spaced sections comprise raised portions.

17. Apparatus according to claim 16, wherein the spaced sections comprise flexible pads.

18. Apparatus according to claim 17, wherein the conveyor means comprises a suction conveyor and the flexible pads are carried by suction on said conveyor.

19. Apparatus according to claim 15, wherein the conveyor means comprises an endless surface and said spaced sections are adjustably carried on said surface.

20. Apparatus according to claim 19, including driven means for adjusting the position of the spaced sections relative to said surface to synchronise said sections with said wrapper feeding means.

21. Apparatus according to claim 19, including means for adjusting the path length of said endless surface to adjust the spacing of said sections.

22. Apparatus for uniting axially-aligned rod-like articles of the tobacco industry, comprising means for transporting said articles successively in an axial direction, means for feeding a succession of wrappers towards said articles, and means for wrapping said wrappers around at least the adjacent portions of at least some of said articles to unit them, said wrapping means comprising a lateral-flexible conveyor carrying spaced laterally-flexible resilient pads each arranged to be interposed between said conveyor and one of said wrappers, and guide means for wrapping said conveyor, pads and wrappers at least partially around said articles such that said pads resiliently press said wrappers onto and around said articles.

* * * * *